US007119263B1

(12) United States Patent
Chen

(10) Patent No.: US 7,119,263 B1
(45) Date of Patent: Oct. 10, 2006

(54) DRUM HEAD TENSION CONTROL DEVICE

(76) Inventor: Kuo-Chang Chen, No. 32, Doutan Rd., Shalu Chen, Taichung (TW)

( * ) Notice: Subject to any disclaimer, the term of this patent is extended or adjusted under 35 U.S.C. 154(b) by 0 days.

(21) Appl. No.: 11/167,114

(22) Filed: Jun. 28, 2005

(51) Int. Cl.
*G10D 13/02* (2006.01)

(52) U.S. Cl. ..... 84/411 A; 84/411 R

(58) Field of Classification Search ..... 84/411 R, 84/413, 421, 411 A
See application file for complete search history.

(56) References Cited

U.S. PATENT DOCUMENTS

2001/0049993 A1* 12/2001 Hagiwara ..... 84/411 R
2002/0029680 A1* 3/2002 Cleland ..... 84/411 R

* cited by examiner

*Primary Examiner*—Kimberly Lockett
(74) *Attorney, Agent, or Firm*—Rabin & Berdo, P.C.

(57) ABSTRACT

A drum head tension control device has a mounting post, two connectors and two adjusting bolts. The mounting post is mounted on a cylindrical shell of a drum between two drum hoops having multiple mounting holes. The connectors are pivotally attached to the mounting post and have a proximal end, a distal end and a threaded hole. The proximal end is attached to the mounting post, and the threaded hole is formed coaxially in the distal end. The adjusting bolts extend respectively through mounting holes in opposite drum hoops and screw respectively into the threaded holes of the connectors to adjust tension on the drum heads.

5 Claims, 5 Drawing Sheets

DRUM HEAD TENSION CONTROL DEVICE

BACKGROUND OF THE INVENTION

1. Field of the Invention

The present invention relates to a drum head tension control device, and particularly relates to a drum head tension control device that is mounted on a drum to adjust the distance between two drum hoops and the resultant tension on the drum heads.

2. Description of Related Art

With reference to FIG. 4, a drum normally has a cylindrical shell (70), two annular drum hoops (80), two drum heads (81) and a tension control device (90). The cylindrical shell includes two round openings and an outer surface face. The drum hoops (80) are mounted respectively on the two openings and are separated by a distance. The drum heads (81) are mounted respectively in the drum hoops (80), cover the two openings, are made of leather or similar resilient material and emit a tone depending on tension applied to the drum heads (81). The tension control device (90) is mounted between the two drum hoops (80) and controls the tone of the drum heads (81) by controlling the distance between the two drum hoops (80).

With further reference to FIG. 5, a conventional tension control device (90) has a mounting post (91), a sleeve (92), a attachment bolt (93) and two adjustment bolts (94). The mounting post (91) is mounted on the outer surface of the of the cylindrical shell (70) and has a proximal end (not numbered), a distal end (not numbered), a longitudinal hole (911) and a transverse hole (912). The longitudinal hole (911) is defined coaxially through the proximal end into the mounting post (91). The transverse hole (912) is formed diametrically through the mounting post (91) near the distal end and communicates with the longitudinal hole (911). A sleeve (92) is mounted through the transverse hole (912) and has a middle (not numbered), two open ends (not numbered), an internal thread (not numbered) and an attachment hole (not numbered). The internal thread is defined longitudinally in the sleeve (92). The attachment hole is defined through the middle of the sleeve (92). The attachment bolt (93) is screwed into the longitudinal hole (911) in the mounting post (91) and the attachment hole in the sleeve (92) to securely hold the sleeve (92) in the transverse hole (912) of the mounting post (91). The adjustment bolts (94) are mounted respectively through two holes respectively in the drum hoops (80) and are screwed respectively into opposite ends of the sleeve (92). Each attachment bolt (94) has a proximal end (not numbered), a distal end (not numbered) and a flange (941). The flange (941) is formed near the distal end of the attachment bolt (94) and abuts the hole in the drum hoop (80) opposite to the sleeve (92). The proximal ends of the adjustment bolts (94) screw respectively into the ends of the sleeve (92) to adjust the distance between the drum hoops (80) and the tension on the drum heads (81).

However, the holes in the drum hoops are not necessarily aligned with each other. Screwing one end of one of the adjustment bolts (94) into one end of the sleeve (92) will cause the opposite end of the sleeve (92) to misalign with the corresponding hole in the opposite drum hoop (80). Consequently, extending the other adjusting bolt (94) through the hole in the opposite drum hoop (80) and screwing it into the other end of the sleeve (92) may be difficult or impossible. Furthermore, the tension on and tone of the drum head (81) may change when the second adjusting bolt (94) is screwed into the sleeve (92).

Therefore, the invention provides a drum head tension control device to mitigate or obviate the aforementioned problems.

SUMMARY OF THE INVENTION

The main objective of the present invention is to provide a drum head tension control device that is impervious to slight misalign of mounting holes in opposite drum hoops.

The drum head tension control device has a mounting post, two connectors and two adjusting bolts. The mounting post is mounted on a cylindrical shell of a drum between two drum hoops having multiple mounting holes. The connectors are pivotally attached to the mounting post and have a proximal end, a distal end and a threaded hole. The proximal end is attached to the mounting post, and the threaded hole is formed coaxially in the distal end. The adjusting bolts extend respectively through mounting holes in opposite drum hoops and screw respectively into the threaded holes of the connectors to adjust tension on the drum heads.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
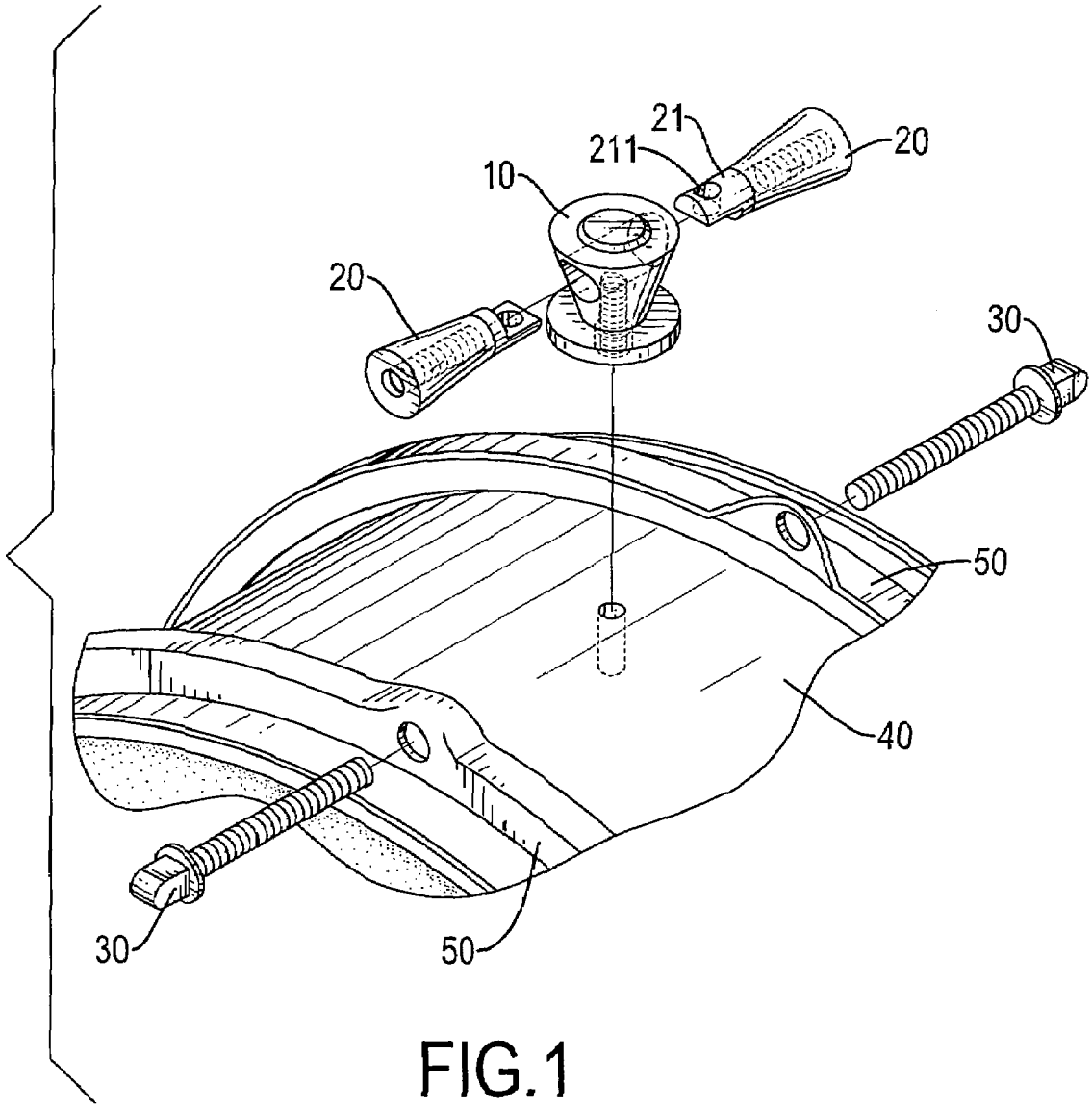
FIG. 1 is a perspective view of the drum head tension control device in accordance with this invention.

With reference to FIG. 1, a drum head tension control device is mounted on an outside surface of a cylindrical drum shell (40) between two drum hoops (50) to adjust tension on drum heads (not numbered) mounted respectively in the drum hoops (50) and comprising a mounting post (10), two connectors (20), an optional mounting bolt (60) and two adjusting bolts (30).

Figure 2:
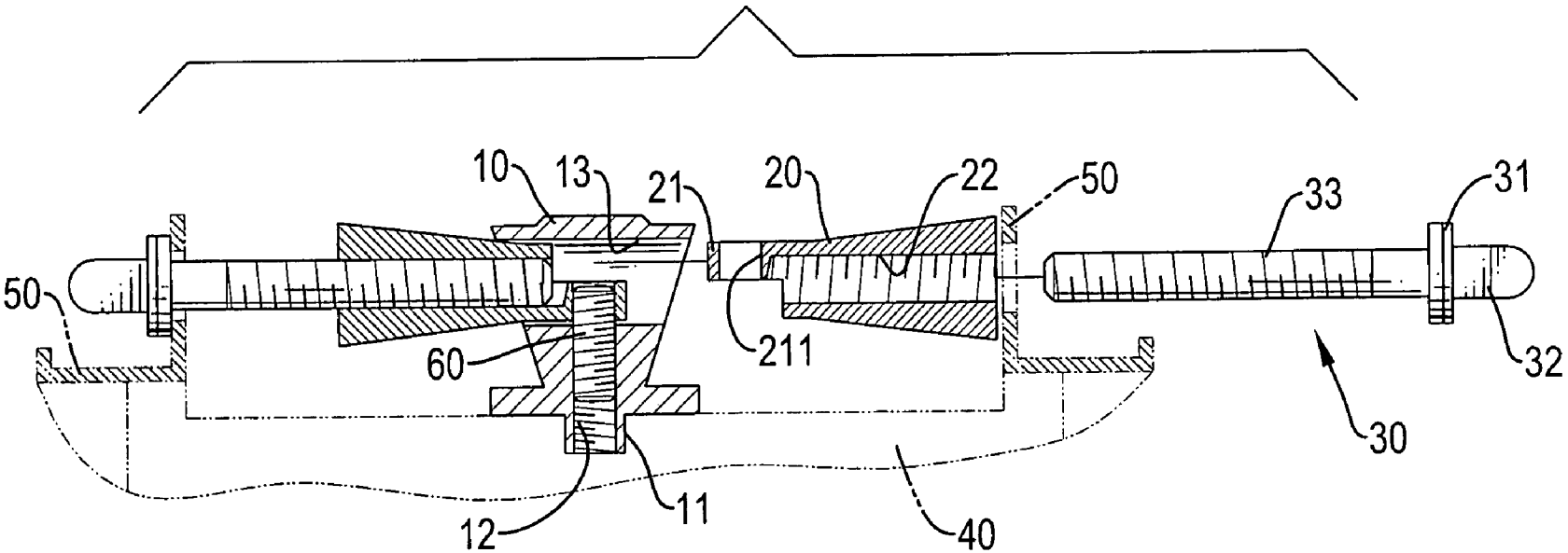
FIG. 2 is an operational side view in partial section of the drum head tension control device in FIG. 1.
Figure 3:
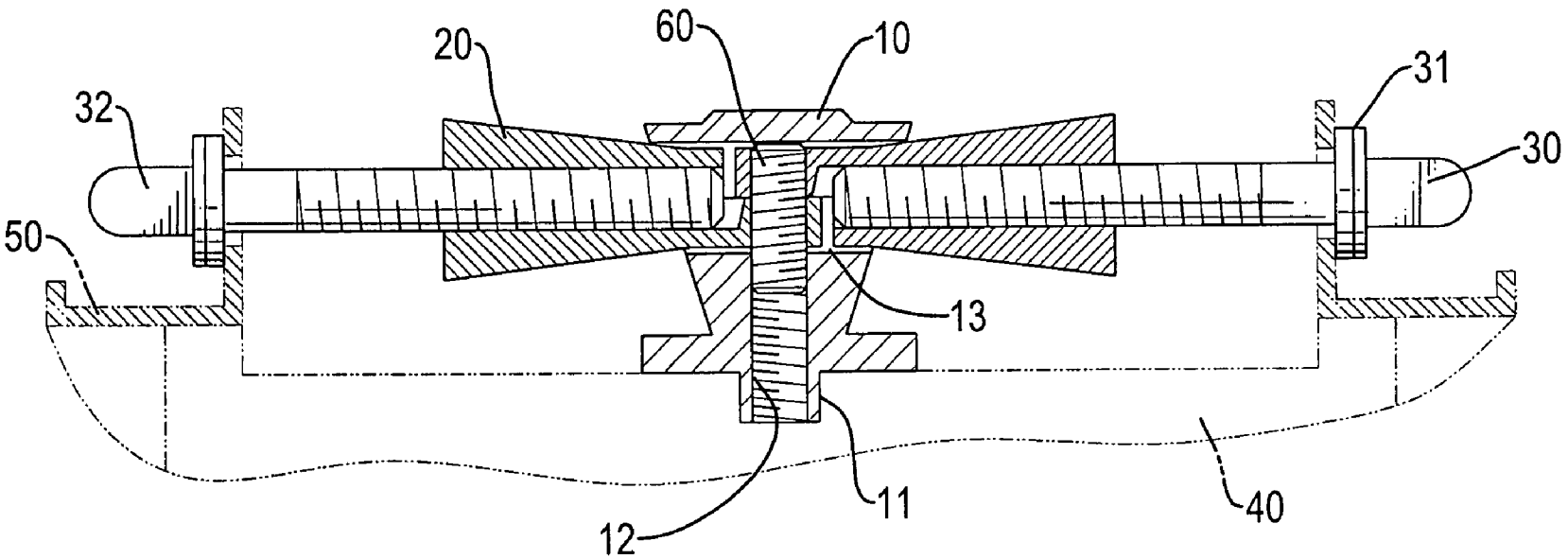
FIG. 3 is a side view in partial section of the drum head tension control device in FIG. 1.
Figure 4:
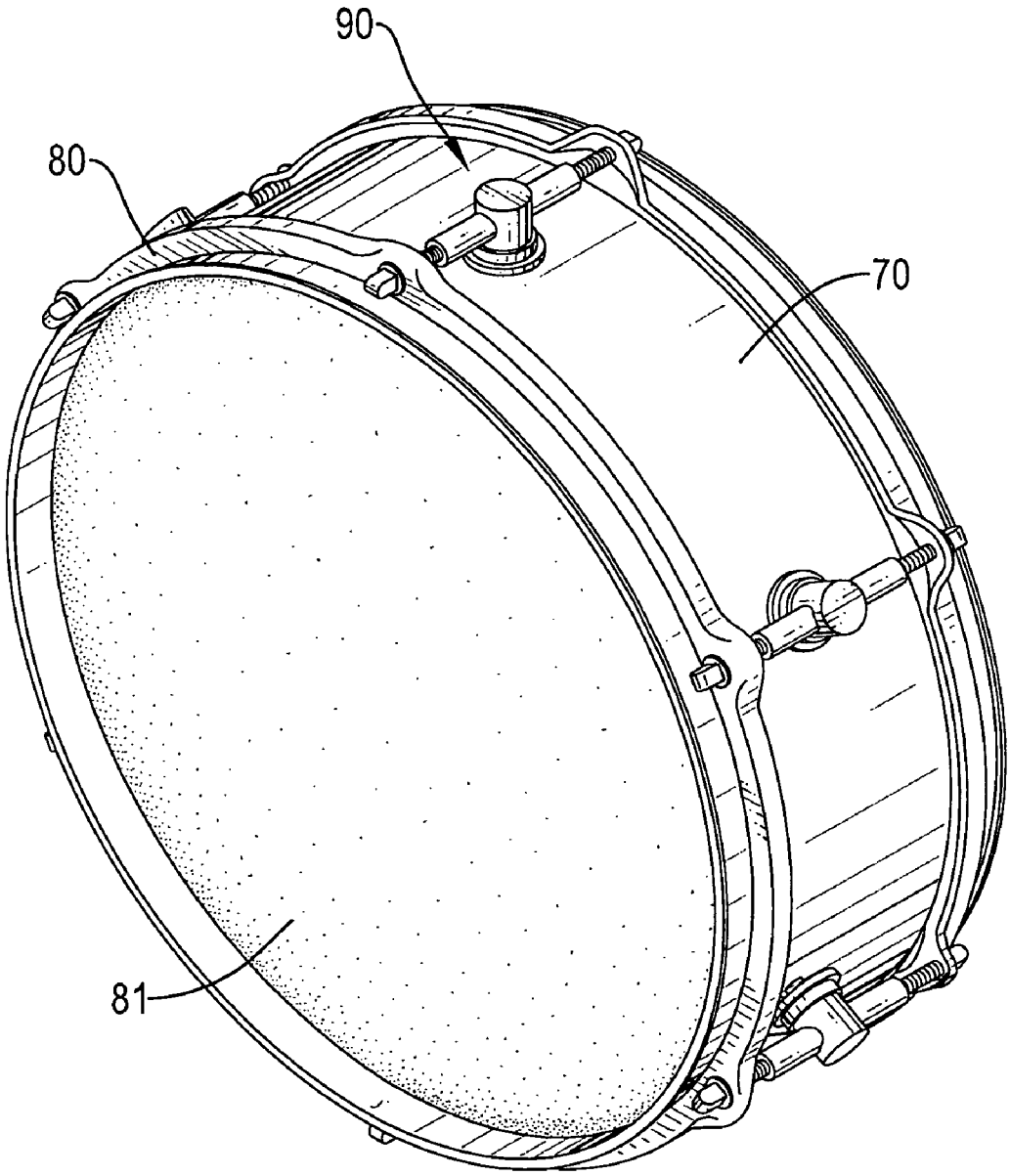
FIG.4 PRIOR ART
FIG. 4 is a perspective view of a drum with conventional drum head tension control devices in accordance with the prior art.
Figure 5:
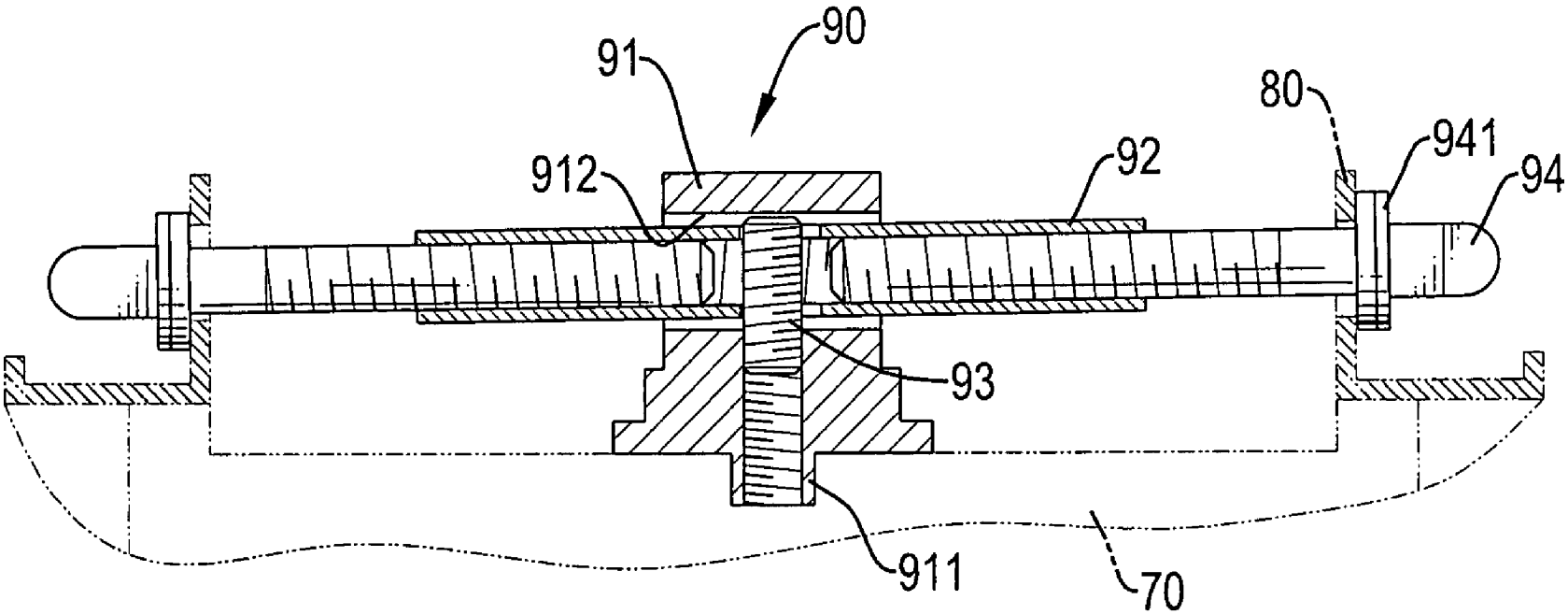
FIG.5 PRIOR ART
FIG. 5 is a side view of a conventional drum head tension control device in FIG. 4.

With reference to FIG. 2 and FIG. 3, the mounting post (10) is mounted on the cylindrical drum shell (40), having a proximal end, a distal end and may have a mounting protrusion (11), a longitudinal hole (12) and a transverse hole (13). The proximal end is attached to the cylindrical drum shell (40). The mounting protrusion (11) is formed on the proximal end of the mounting post (10) and is mounted in a hole in the cylindrical drum shell (40). The longitudinal hole (12) is defined coaxially in the mounting post (10) through the proximal end. The transverse hole (13) is defined diametrically through the mounting post (10) near the distal end and communicates with the longitudinal hole (12).

The connectors (20) are tubular and are attached pivotally to the mounting post (10), and each connector (20) has an open distal end, a closed proximal end, a threaded hole (22) and an optional connecting tab (21). The closed proximal end is attached pivotally to the mounting post (10). The threaded hole (22) is defined coaxially in the connector (20) through the distal end. The connecting tab (21) is formed on and protrudes longitudinally from half of the proximal end, has a through hole (211) and may be semicylindrical. The through hole (211) is defined transversely through the mounting tab (21), corresponds to the longitudinal hole (12) in the mounting post (10), is mounted in the transverse hole (13) in the mounting post (10) and aligns with the longitudinal hole (12) in the mounting post (10).

The mounting bolt (60) screws into the longitudinal hole (12) in the mounting post (10) and protrudes into the transverse hole (13) and through the through holes (211) in the connecting tabs (21) to hold the connectors (20) in the mounting post (10).

The adjusting bolts (30) are threaded, mount respectively through holes respectively in opposite drum hoops (50) and screw respectively into the threaded holes (22) in the connectors (20). Each adjusting bolt (30) has a distal end, a proximal end, a flange (31) and an optional head (32). The flange (31) is formed around the adjusting bolt (30) near the distal end and abuts and holds the corresponding drum hoop (50) when the adjusting bolt (30) is mounted through a hole in the drum hoop (50) and screwed into the distal end of the connector (20). The head (32) is formed on the distal end of the adjusting bolt (30) so the adjusting bolt (30) can be easily screwed into or out of the distal end of the connector (20).

By rotating the head (32), the inserted depth for the threaded hole (22) of the respective adjusting screw (30) is adjusted, to further regulate the distance between the two drum hoops (50), the relative relations of the drum hoop (50) and the drum (40), and the compactness of a piece of leather and the drum (40).

Because the adjusting bolts (30) are connected respectively to the connectors (20) separate from each other, the operation of one adjusting bolt (30) will not change the position of the other adjusting bolt (30). Therefore, the adjusting bolts (30) can be adjusted individually, and the tension control device is convenient in use.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A drum head tension control device mounted on an outside surface of a cylindrical drum shell (40) between two drum hoops (50), the drum head tension control device comprising:

a mounting post (10) adapted to be mounted on a cylindrical drum shell (40) and having a proximal end adapted to be attached to the cylindrical drum shell (40); and a distal end;

two connectors (20) being tubular and attached pivotally to the mounting post (10), and each connector (20) having open distal end;

a closed proximal end attached pivotally to the mounting post (10); and a threaded hole (22) defined coaxially through the open distal end; and two adjusting bolts (30) being threaded, adapted to be mounted respectively through holes respectively in opposite drum hoops (50) and screwing respectively into the threaded holes (22) in the connectors (20), and each adjusting bolt (30) having a distal end;

a proximal end;

a flange (31) formed around the adjusting bolt (30) near the distal end for abutting and holding the corresponding drum hoop (50).

2. The drum head tension control device as claimed in claim 1 wherein the mounting post (10) further has a mounting protrusion (11) formed on the proximal end of the mounting post (10) and adapted to be mounted in a hole in the cylindrical drum shell (40).

3. The drum head tension control device as claimed in claim 2 wherein the mounting post (10) further has a longitudinal hole (12) defined coaxially in the mounting post (10) through the proximal end; and a transverse hole (13) defined diametrically through the mounting post (10) near the distal end and communicating with the longitudinal hole (12); and each connector (20) further has a connecting tab (21) formed on and protruding longitudinally from half of the proximal end and having a through hole (211) defined transversely through the mounting tab (21), corresponding to the longitudinal hole (12) in the mounting post (10), is mounted in the transverse hole (13) in the mounting post (10) and aligns with the longitudinal hole (12) in the mounting post (10); and the drum head tension control device further comprises a mounting bolt (60) screwing into the longitudinal hole (12) in the mounting post (10) and protruding into the transverse hole (13) in the mounting post (10) and through the through holes (211) in the connecting tab to hold the connector (20) in the mounting post (10).

4. The drum head tension control device as claimed in claim 1 wherein the adjusting bolt (30) further has a head (30) formed on the distal end.

5. The drum head tension control device as claimed in claim 3 wherein each connecting tab (21) is semicylindrical.

* * * * *